United States Patent [19]

Rogero

[11] 4,273,980

[45] Jun. 16, 1981

[54] SPRING-LOADED CATCH MECHANISM FOR PUSH-BUTTONS OF ELECTRICAL APPARATUS

[76] Inventor: Jean Rogero, Rue de l'Industrie, 82270 Montpezat de Quercy, France

[21] Appl. No.: 88,074

[22] Filed: Oct. 24, 1979

[30] Foreign Application Priority Data

Oct. 26, 1978 [FR] France ..... 78 30436

[51] Int. Cl.[3] ..... H01H 3/14; H01H 13/56

[52] U.S. Cl. ..... 200/328

[58] Field of Search ..... 200/328, 324

[56] References Cited

U.S. PATENT DOCUMENTS 3,970,806 7/1976 Distler ..... 200/328

4,112,277 9/1978 Kleeb ..... 200/328

FOREIGN PATENT DOCUMENTS 2131934 12/1972 Fed. Rep. of Germany ..... 200/328

1132611 11/1968 United Kingdom ..... 200/328

*Primary Examiner*—Willis Little

*Attorney, Agent, or Firm*—Larson, Taylor and Hinds

[57] ABSTRACT

An electrical apparatus such as a switch comprises a housing and a push-button. A spring-loaded catch mechanism holds the push-button alternately in a rest position and in a working position for which the push-button protrudes more or less from the housing. The catch mechanism comprises a catching lever which is mounted through an integral pivot accommodated in a hole of a wall of the housing and which has a depressed area receiving a pin carried by a wall of the push-button. The depressed area is bounded by ramps which are successively engaged by the pin for oscillating the catching lever about its pivot. A resilient finger, integral with the catching lever, brakes the latter by pressing against the wall of the housing. The catching lever, the housing and the push-button are made of plastic material.

6 Claims, 8 Drawing Figures

SPRING-LOADED CATCH MECHANISM FOR PUSH-BUTTONS OF ELECTRICAL APPARATUS

FIELD OF THE INVENTION

The invention relates to a spring-loaded catch mechanism for a push-button of an electrical apparatus, said push-button being slidably guided in a housing relatively to which it is urged outwardly by a return spring, which catch mechanism includes a catching lever of plastic material pivotally mounted on said housing through a pivot and including a depressed area which is limited at least partly at its outer periphery through projecting ramps and near the center of which projects an integral stud member bounded by a notch and by further ramps, said push-button being provided with a pin accommodated in the depressed area of said catching lever and said ramps being shaped and arranged so that, when push-button is depressed from a rest position and then released, said ramps reciprocate the catching lever about its pivot and thus constrain the pin to by-pass the stud member along one side thereof and then to lie under said stud member, after which said return spring urges the pin into the notch and holds it therein in a working position, whereas, when the push-button is depressed from this working position and then released, said ramps reciprocate the catching lever about its pivot and thus constrain the pin to by-pass the stud member along the opposite side thereof and then to lie above said stud member, after which said return spring urges the push-button to and holds it in its rest position, and so on, braking means being provided for braking the movements of the catching lever.

BACKGROUND OF THE INVENTION

Such catch mechanisms are disclosed in German patent applications Nos. 1,064,562 and 1,179,282.

According to German patent application No. 1,064,562 the pivot of the catching lever consists of a separate metal rivet which is fixed to the housing and which is surrounded with a separate metal sleeve. The braking means coacting with the catching lever consists of a separate spring washer.

Similarly according to German patent application No. 1,179,282 the pivot of the catching lever consists of a metal pin held by a cotter. The braking means coacting with the catching lever consists of a leaf spring which, by reacting upon a washer arrested by the above cotter, urges the catching lever against the upper surface of the housing or body of the electrical apparatus.

An object of the present invention is to simplify the making and assembling of the catch mechanism. Another object of this invention is to silence the function of said mechanism by suppressing as many metal pieces as possible.

SUMMARY OF THE INVENTION

To this end, in a catch mechanism made in accordance with the present invention the catching lever is made integral with its pivot which is accommodated in a hole provided in a wall of the housing as well as with the braking means, said catching lever including as said braking means a relatively thin, resiliently deformable finger portion which at rest projects locally relatively to the whole of the catching lever from the same side as the pivot and thus presses on that housing wall provided with said hole with a pressure sufficient to prevent the catching lever from rotating in the absence of any forces exerted through engagement of the pin with said ramps.

The invention thus allows of substituting a single piece of plastic material to the catching lever and to all the auxiliary metal pieces of the prior art (pivot, sleeve, washer, cotter, leaf spring, etc.).

The only modifications required to be brought to the other portions of the apparatus for carrying out the invention consist in providing on the one hand in the housing the hole for accommodating the pivot of the catching lever and on the other hand on the push-button the pin adapted to coact with the ramps and with the notch of the catching lever. As the catch mechanism brings into play only relative movements between three members of plastic material (housing, catching lever and push-button) and the deformation of the return spring, its function is quite noiseless.

In this specification when it is stated that the pin lies "under" or "above" the stud member or when there are used expressions as "upper" or "lower", it is supposed that the electrical apparatus is positioned so that its push-button is reciprocable in a substantially vertical direction and protrudes from the housing at the top thereof. The apparatus may however be positioned otherwise.

According to a preferred embodiment of the invention, the catching lever is of an elongated shape and comprises at a longitudinal end thereof said relatively thin, resiliently deformable finger portion as well as a second finger portion parallel to the relatively thin finger portion and separate from the latter, said second finger portion being relatively thick and consequently rigid and carrying integrally the pivot of the catching member. The shape thus given to the catching lever allows it of being more easily accommodated between the push-button and the housing while being given the required clearance space.

The depressed area is preferably open to that edge of the catching lever remote from the pivot while the corresponding depressed areas of the prior art constructions are of closed outlines. This feature of the invention facilitates the insertion of the pin into said depressed area during the assembling operations.

Other features and advantages of the invention will be set forth in or apparent from the detailed description of a preferred embodiment found hereinbelow.

BRIEF DESCRIPTION OF THE DRAWINGS

FIGS. 2 to 8 are drawn at an enlarged scale relatively to FIG. 1.

DESCRIPTION OF THE PREFERRED EMBODIMENT

Figure 1:
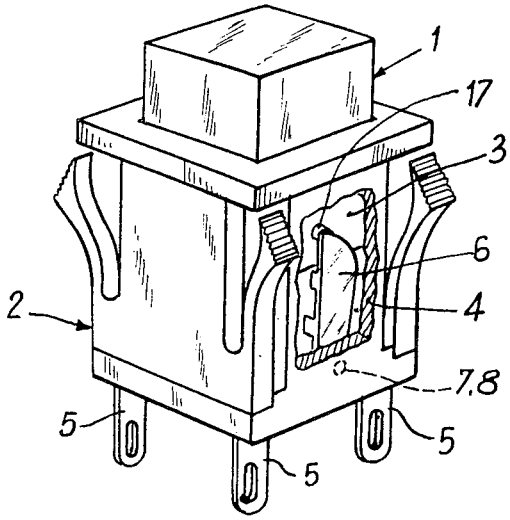
FIG. 1 shows a perspective view of an electrical switch provided with a spring-loaded catch mechanism made in accordance with the invention, a wall of the housing of this switch being cut out in order to expose the main elements of this mechanism.

As appears from FIG. 1, an electrical switch adapted to be provided with a spring-loaded catch mechanism includes a push-button 1 slidably guided in a housing 2 from which it protrudes more or less under the action of a return spring (not shown). At its outside this push-button 1 is for instance parallelepiped shaped and is slidably guided through a suitable geometrical configuration given to the inner surfaces of housing 2. Push-button 1 and housing 2 have longitudinal walls parallel to axis X—X (see FIGS. 4 to 8) of the reciprocating movement of push-button 1. In particular there are denoted 3 and 4 respectively in FIGS. 1 and 2 two such longitudinal walls which are parallel to each other and belong respectively to push-button 1 and housing 2. As they are not directly related to the invention the electric components of this switch are not shown in the drawings with the exception of input and output connections 5 (see FIG. 1).

Figures 4, 5, 6, 7, 8:
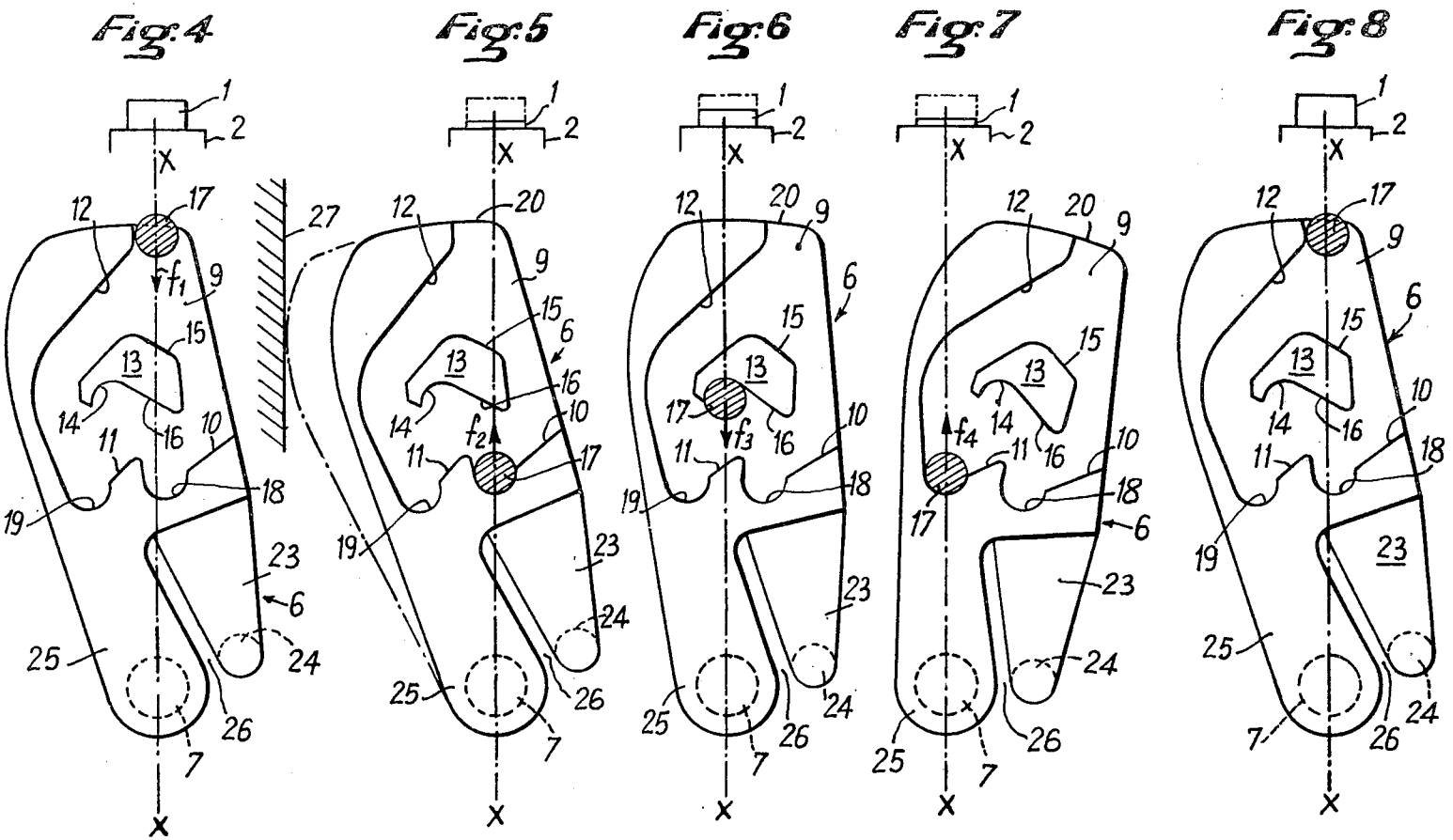
FIGS. 4 to 8 show front views of the catching lever together with the protruding portion of the push-button and illustrate the successive steps of operation of the spring-loaded catch mechanism.

The switch includes a spring-loaded catch mechanism adapted to hold push-button 1 alternately in a rest position or position of greater protrusion (FIG. 1 and top of FIGS. 4 and 8) and in a working position or position of lesser protrusion (top of FIG. 6).

Figure 3:
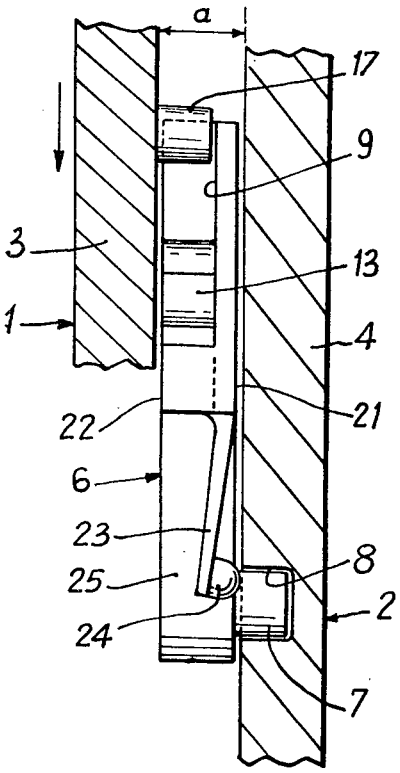
FIG. 3 shows a side view of the catching lever similar to that of FIG. 2, said lever being positioned between the housing and the push-button both shown partly in section.

This catch mechanism includes a catching lever 6 made of a flat piece of plastic material, provided with an integral pivot 7 which is accommodated in a corresponding hole 8 made in housing wall 4 so that catching lever 6 may rotate through a limited angle about its pivot 7, in a plane parallel to axis X—X, said plane being perpendicular to that of FIG. 3 and parallel to that of FIGS. 4 to 8.

Catching lever 6 includes a depressed area 9 which is limited partly at is outer periphery through projecting ramps 10, 11 and 12 and near the center of which projects an integral stud member 13 limited by a notch 14 and by further ramps 15 and 16.

On its wall 3, push-button 1 is provided with a pin 17 accommodated in depressed area 9 and adapted to follow alternately ramps 10, 11, 12 of said depressed area 9 and ramps 15, 16 of stud member 13 so as to rotate catching lever 6.

Said ramps 10, 11, 12, 15 and 16 are shaped and arranged so that, when push-button 1 is depressed from a rest position (FIG. 4) and then released, ramps 15, 10 and 16 reciprocate catching lever 6 about its pivot 7 and thus constrain pin 17 to by-pass stud member 13 along one side thereof (right side in FIGS. 4 to 8) and then to lie under said stud member 13 (see FIG. 5), after which said return spring urges pin 1 into notch 14 and holds it therein (working position, FIG. 6). The above ramps are also shaped and arranged so that, when push-button 1 is depressed from the working position of FIG. 6 and then released, ramps 11 and 12 reciprocate catching lever 6 about pivot 7 and thus constrain pin 17 to by-pass stud member 13 along the opposite side thereof (left side in FIGS. 4 to 8) and then to lie above said stud member 13, after which the return spring urges again push-button 1 to its rest position and then holds it in rest position (FIG. 8, which is identical to FIG. 1).

These movements repeat alternately whenever push-button 1 is depressed.

According to a preferred embodiment, stud member 13 comprises an upper ramp 15 and a lower ramp 16 which are similarly orientated with respect to the axis X—X of the movement of translation, said lower ramp 16 ending in notch 14, and depressed area 9 comprises two lower ramps 10, 11 and an upper ramp 12 all of which are orientated at the opposite of the above ramps 15, 16 with respect to axis X—X, said latter lower ramps 10, 11 ending each in a notch 18 or 19 and the latter upper ramp 12 ending at the upper edge 20 of catching lever 6.

Figure 2:
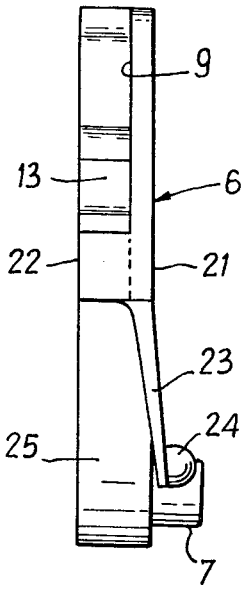
FIG. 2 shows separately a side view of the catching lever.

As appears from FIGS. 2 and 3, the body of catching lever 6, including stud member 13, is bounded by two flat faces 21, 22 parallel to each other, area 9 being sunk with respect to face 22. The gap between the outer face of wall 3 of push-button 1 and the inner face of wall 4 of housing 2 is of a width a (FIG. 3) which is equal (any clearance space apart) to the spacing between faces 21 and 22 of catching lever 6. Pivot 7 projects integrally from face 21.

Catching lever 6 includes a relatively thin, resiliently deformable finger portion 23 which at rest (see FIG. 2) projects locally from face 21 of catching lever 6 and thus presses on that housing wall 4 provided with hole 8 with a pressure sufficient to prevent normally catching lever 6 from rotating about its pivot 7. At its free end, finger portion 23 is provided with a contacting projection 24 through which finger portion 23 presses against housing wall 4.

Preferably catching lever 6 is of an elongated shape substantially along axis X—X. At a longitudinal end, said lever 6 comprises beside finger portion 23 a second finger portion 25 parallel to finger portion 23 and separated from the latter through a slit 26, said second finger portion 25 being relatively thick and consequently rigid and carrying pivot 7 integrally.

There is thus obtained a switch which is assemblable as conventional switches, with the exception of its spring-loaded catch mechanism. For assembling this mechanism, it suffices to insert catching lever 6 between walls 3 and 4 while inserting pivot 7 into hole 8 and pin 17 into depressed area 9 through the laterally open edge of this area.

This spring loaded catch mechanism operates as follows:

Starting from the rest position shown in FIGS. 1, 3 and 4 where push-button 1 protrudes at the highest level from housing 2, the user depresses this push-button 1, which lowers its pin 17 in the direction of arrow $f_1$ in FIG. 4. While going down, pin 17 engages ramp 15 of stud member 13, which engagement rotates catching lever 6 anticlockwise, the rotation of this lever 6 being limited by an abutment 27 on housing 2 (see the position shown by a dot-and-dash line in FIG. 5). After having by-passed stud member 13 along its right side, pin 17 engages the ramp 10 of depressed area 9, which engagement rotates catching lever 6 clockwise until ramp 16 of stud member 13 lies above pin 17 (FIG. 5). Warned by the entering of pin 17 into notch 18, the user releases push-button 1 which is then raised by its return spring. Consequently pin 17 goes up in the direction of arrow $f_2$ in FIG. 5 and engages ramp 16, which engagement rotates catching lever 6 further on clockwise until pin 17 enters notch 14 (FIG. 6).

Starting now from the working position shown in FIG. 6 where push-button 1 protrudes but slightly, the user depresses this push-button 1, which lowers its pin 17 in the direction of arrow $f_3$. While going down, pin 17 engages the ramp 11 of depressed area 9, which engagement rotates catching lever 6 clockwise until pin 17 lies on the left side of stud member 13. Warned by the entering of pin 17 into notch 19, the user releases push-button 1 which is then raised by its return spring. Consequently pin 17 goes up in the direction of arrow $f_4$ in FIG. 7 and engages ramp 12, which engagement then rotates catching lever 6 anticlockwise to the position of FIG. 8 where pin 17 slips from ramp 12. In this end position as well as in some intermediate positions, catching lever 6 is braked by the resilient engagement of its projection 24 with the housing wall 4.

In both end positions (FIG. 1 or 8 and FIG. 4) pin 17 is aligned vertically with pivot 7, which prevents catching lever 6 from rotating unexpectedly.

Preferably the said return spring is a helical compression spring accommodated partly inside that wall of push-button 1 which is remote from wall 3 provided with the pin 17 of the catch mechanism and abutted against a transverse wall of housing 2.

Although the invention has been described relative to examplary embodiments thereof, it will be understood that other variations and modifications can be effected in these embodiments without departing from the scope and spirit of the invention.

I claim:

1. A spring-loaded catch mechanism for a push-button of an electrical apparatus, said push-button being slidably guided in a housing relatively to which it is urged outwardly by a return spring, which catch mechanism includes a catching lever of plastic material pivotally mounted on said housing through a pivot and including a depressed area which is limited at least partly at its outer periphery through projecting ramps and near the center of which projects an integral stud member bounded by a notch and by further ramps, said push-button being provided with a pin accommodated in the depressed area of said catching lever and said ramps being shaped and arranged so that, when push-button is depressed from a rest position and then released, said ramps reciprocate the catching lever about its pivot and thus constrain the pin to by-pass the stud member along one side thereof and then to lie under said stud member, after which said return spring urges the pin into the notch and holds it therein in a working position, whereas, when the push-button is depressed from this working position and then released, said ramps reciprocate the catching lever about its pivot and thus constrain the pin to by-pass the stud member along the opposite side thereof and then to lie above said stud member, after which said return spring urges the push-button to and holds it in its rest position, and so on, braking means being provided for braking the movements of the catching lever, wherein the catching lever is made integral with its pivot which is accommodated in a hole provided in a wall of the housing as well as with the braking means, said catching lever including as said braking means a relatively thin, resiliently deformable finger portion which at rest projects locally relatively to the whole of the catching lever from the same side as the pivot and thus presses on that housing wall provided with said hole with a pressure sufficient to prevent the catching lever from rotating in the absence of any forces exerted through engagement of the pin with said ramps.

2. A mechanism as claimed in claim 1 wherein the catching lever is of an elongated shape and comprises at a longitudinal end thereof said relatively thin, resiliently deformable finger portion as well as a second finger portion parallel to the relatively thin finger portion and separate from the latter, said second finger portion being relatively thick and consequently rigid and carrying integrally the pivot of the catching member.

3. A mechanism as claimed in claim 2 wherein said relatively thin, resiliently deformable finger portion of catching lever is provided with a contacting projection through which said resiliently deformable finger portion presses on said housing wall.

4. A mechanism as claimed in claim 1 wherein said return spring is a helical compression spring accommodated partly inside that wall of said push-button remote from said wall carrying said pin.

5. A mechanism as claimed in claim 1 wherein the depressed area is open to that edge of the catching lever remote from the pivot.

6. An electrical apparatus comprising a housing and a push-button having a spring-loaded catch mechanism, said push-button being slidably guided in said housing relatively to which it is urged outwardly by a return spring, which catch mechanism includes a catching lever of plastic material pivotally mounted on said housing through a pivot and including a depressed area which is limited at least partly at its outer periphery through projecting ramps and near the center of which projects an integral stud member bounded by a notch and by further ramps, said push-button being provided with a pin accommodated in the depressed area of said catching lever and said ramps being shaped and arranged so that, when push-button is depressed from a rest position and then released, said ramps reciprocate the catching lever about its pivot and thus constrain the pin to by-pass the stud member along one side thereof and then to lie under said stud member, after which said return spring urges the pin into the notch and holds it therein in a working position, whereas, when the push-button is depressed from this working position and then released, said ramps reciprocate the catching lever about its pivot and thus constrain the pin to by-pass the stud member along the opposite side thereof and then to lie above said stud member, after which said return spring urges the push-button to and holds it in its rest position, and so on, braking means being provided for braking the movements of the catching lever, wherein the catching lever is made integral with its pivot which is accommodated in a hole provided in a wall of the housing as well as with the braking means, said catching lever including as said braking means a relativey thin, resiliently deformable finger portion which at rest projects locally relatively to the whole of the catching lever from the same side as the pivot and thus presses on that housing wall provided with said hole with a pressure sufficient to prevent the catching lever from rotating in the absence of any forces exerted through engagement of the pin with said ramps.

* * * * *